US005864913A

United States Patent [19]

Robertson et al.

[11] Patent Number: 5,864,913

[45] Date of Patent: Feb. 2, 1999

[54] WINDOW CLEANING SQUEEGEE

[75] Inventors: Brock Robertson, Arcadia; David Rognlien; Barbara Rognlien, both of Los Angeles, all of Calif.

[73] Assignee: Carrand Companies, Inc., Compton, Calif.

[21] Appl. No.: 24,735

[22] Filed: Feb. 17, 1998

[51] Int. Cl.[6] ..... A47L 1/06; A47L 13/12

[52] U.S. Cl. ..... 15/121; 15/220.1; 15/232; 15/244.3

[58] Field of Search ..... 15/121, 220.1, 15/229.11, 232, 244.1, 244.3

[56] References Cited

U.S. PATENT DOCUMENTS

| | | | |
|---|---|---|---|
| 3,724,017 | 4/1973 | Mallory | 15/232 X |
| 3,783,469 | 1/1974 | Siemund | 15/121 X |
| 3,789,451 | 2/1974 | Laitner | 15/121 X |
| 4,050,111 | 9/1977 | Mallory | 15/244.3 X |
| 5,371,914 | 12/1994 | Mallory et al. | 15/244.3 X |
| 5,448,793 | 9/1995 | Mallory et al. | 15/121 X |

*Primary Examiner*—Mark Spisich
*Attorney, Agent, or Firm*—George R. McGuire

[57] ABSTRACT

A window cleaning squeegee of the type having a handle and a head extending transverse to the handle, with the head having first and second elongated channels formed on opposite sides thereof. The first channel receiving a cleaning assembly comprising a sponge, an enveloping net-like webbing and a stiffener element. The stiffener element has an end which is located outside the first channel and which engages the sponge and the webbing. This end being of essentially triangular cross-section. The second channel further includes an elongated rubber blade slidingly received therein.

13 Claims, 4 Drawing Sheets

WINDOW CLEANING SQUEEGEE

BACKGROUND OF THE INVENTION

The present invention generally relates to window cleaning devices, and more particularly, to the type of cleaning devices generally referred to as squeegees.

Squeegee type window cleaners generally include an elongated handle and an integral, elongated head extending perpendicularly across one end thereof. The head includes an elongated channel extending longitudinally therealong and in which a window cleaning sponge is positioned and secured by a clamping mechanism. Some prior art squeegee heads may further include a second channel, smaller in width than the first, sponge channel, in which a rubber blade is securely positioned. In use, the cleaning fluid soaked sponge is moved back and forth across a window and then the rubber blade is passed across the window to remove the cleaning fluid therefrom.

While the sponge alone serves as an effective cleaner for removing dirt from a window, car windshields often accumulate debris that becomes more strongly adhered to the glass, such as bugs and tar. In order to effectively remove the more strongly adhered debris from windows, prior art squeegees placed a netting in enveloping relation to the sponge, whereby the netting acts as a scraper. This arrangement effectively serves as a windshield cleaner, but with the prior art clamping mechanisms, particularly in cold weather climates where the cleaning fluid freezes and causes the sponge to become heavier, the netting quickly rips (typically beginning at the edges) and pulls the sponge outwardly away from the head.

It is therefore a principal object and advantage of the present invention to provide a squeegee type window cleaning device having an improved mechanism for retaining a sponge within the channel formed in the head.

It is another object and advantage of the present invention to provide a more durable netting arrangement in enveloping relation around the sponge.

It is a further object and advantage of the present invention to provide a squeegee that lasts longer than the prior art devices in cold weather climates.

Other objects and advantages of the present invention will in part be obvious, and in part, appear hereinafter.

SUMMARY OF THE INVENTION

In accordance with the foregoing objects and advantages, the present invention provides a squeegee type window cleaning device having an elongated handle and a head portion integrally, perpendicularly extending across one end thereof. The head includes first and second channels extending on opposing sides, longitudinally thereacross. A conventional rubber blade is slidingly inserted within the second channel.

A sponge having an essentially square, transverse cross-section and a V-shaped channel formed longitudinally through one side thereof is securely positioned within the head's first channel. Prior to insertion of the sponge into the channel, a sheet of netting is wrapped in complete enveloping relation around the sponge with the terminal top and bottom edges of the netting being positioned at the vortex of the V-shaped channel. The side edges of the netting positioned adjacent the ends of the sponge are doubled over themselves, thereby doubling the strength of the netting at their most vulnerable places.

An elongated stiffener having a cross-shaped stem and a triangularly shaped base portion is longitudinally positioned within and forced downwardly into the sponge's V-shaped channel, prior to connecting the sponge to the head, thereby causing the sponge to wrap around the triangular base portion of the insert. The stiffener is then inserted into the channel formed through the head such that the cross arm portion is positioned within the channel, the triangular base is positioned outside the channel, and a portion of the sponge and webbing is clamped or squeezed between the channel's edge and the stiffener's stem. A plurality of triangular protrusions are formed in side by side relation longitudinally along both sides of the triangular base portion. The triangular protrusions engage and further retain the sponge in fixed relation to the stiffener.

A pair of flanges are integrally positioned on the ends of the stiffener. The flanges permit the stiffener to be accurately located within the channel and they are in covering relation to the ends of the channel, thereby enclosing the channel and prohibiting foreign matter from infiltrating therein.

BRIEF DESCRIPTION OF THE DRAWINGS

The present invention will be further described in the following Detailed Description and better understood when read in light of the accompanying drawings, wherein.

DETAILED DESCRIPTION

Figure 1:
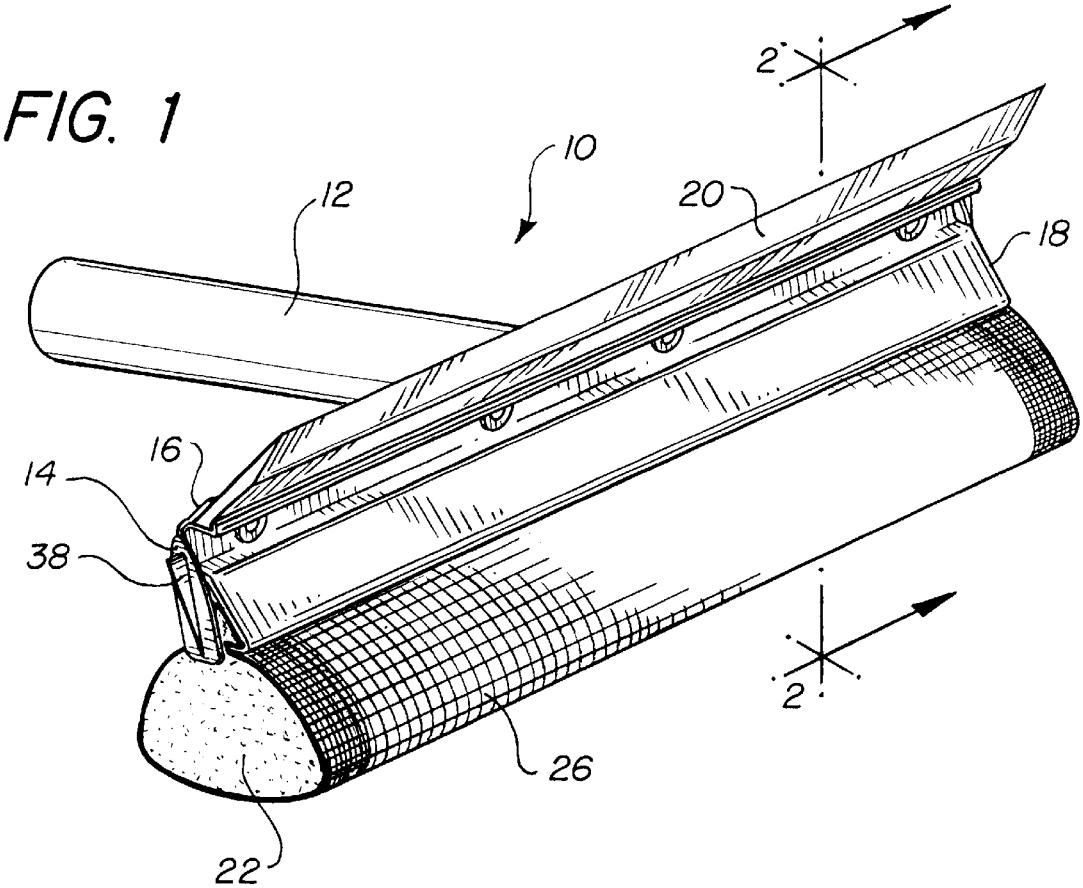
FIG. 1 is a perspective view of a squeegee type window cleaning device.

Referring now to the drawings, wherein like reference numerals refer to like parts throughout, there is seen in FIG. 1 a squeegee type window cleaning device (hereinafter referred to as a "squeegee"), designated generally by reference numeral 10. Squeegee 10 generally includes an elongated handle 12 and a head 14 fixedly attached to and extending perpendicularly across one end of handle 12.

Head 14 includes an essentially C-shaped body with a first channel 16 defined on one end thereof, and a second channel 18 defined on the opposite end thereof. Channels 16 and 18 each include terminal edges 13, 15 and 17, 19, respectively, positioned in facing relation to one another and defining an opening therebetween, and each extend longitudinally along the entire length of body 14, with channel 16 being of a narrower width than channel 18. In addition, the width of the openings defined by edges 13, 15 and 17, 19 are narrower than the width separating the interior walls 23, and 25, 27 of channels 16 and 18, respectively, thereby permitting secure engagement of elements within the channels.

An elongated rubber blade 20 includes an essentially triangular profile that permits it to be securely, slidingly positioned within channel 16. Blade 20 may be used to wipe liquid off from the surface of a window or windshield.

Figure 3:
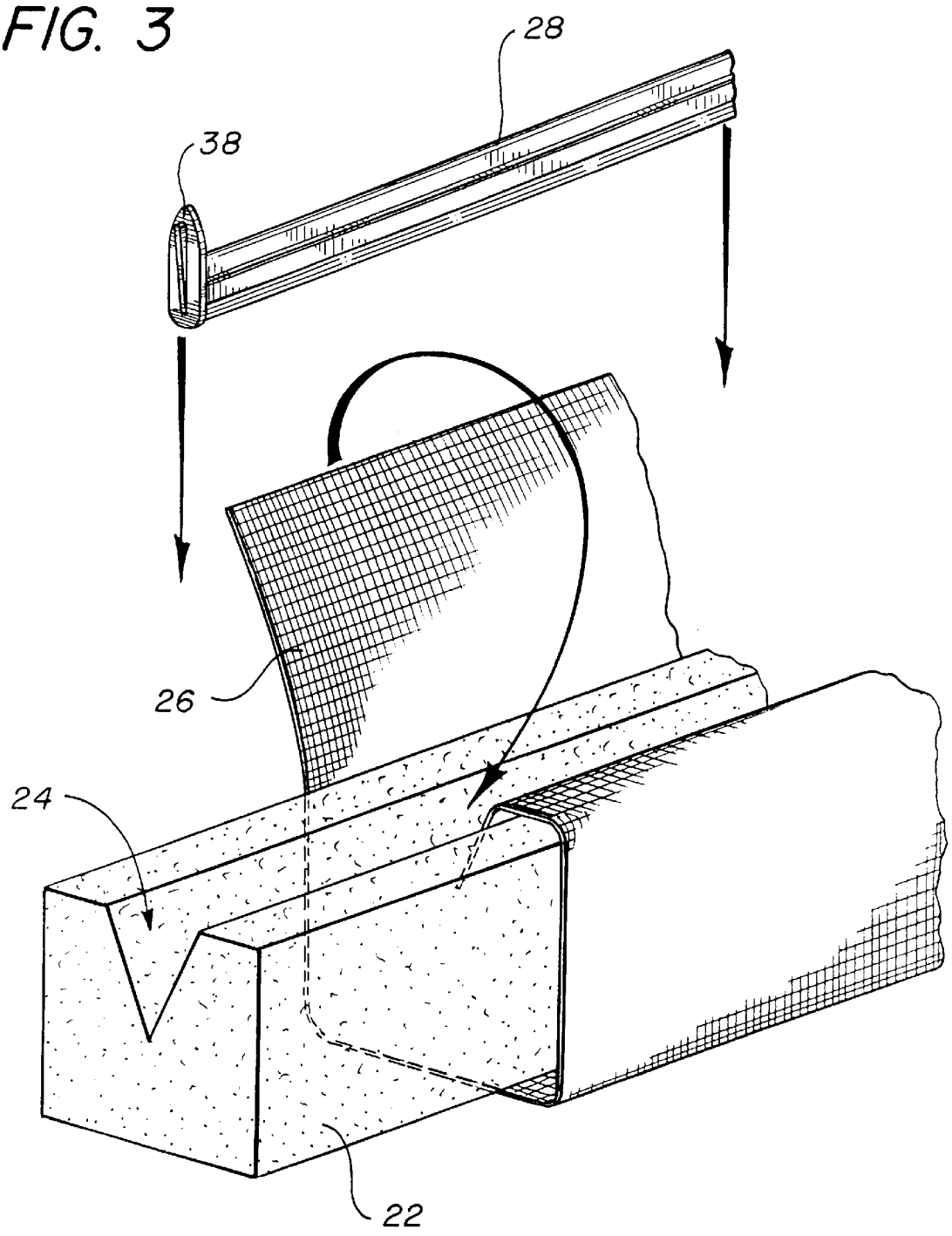
FIG. 3 is an exploded, fragmented perspective of the sponge, webbing and stiffener portions of the present invention.
Figure 4:
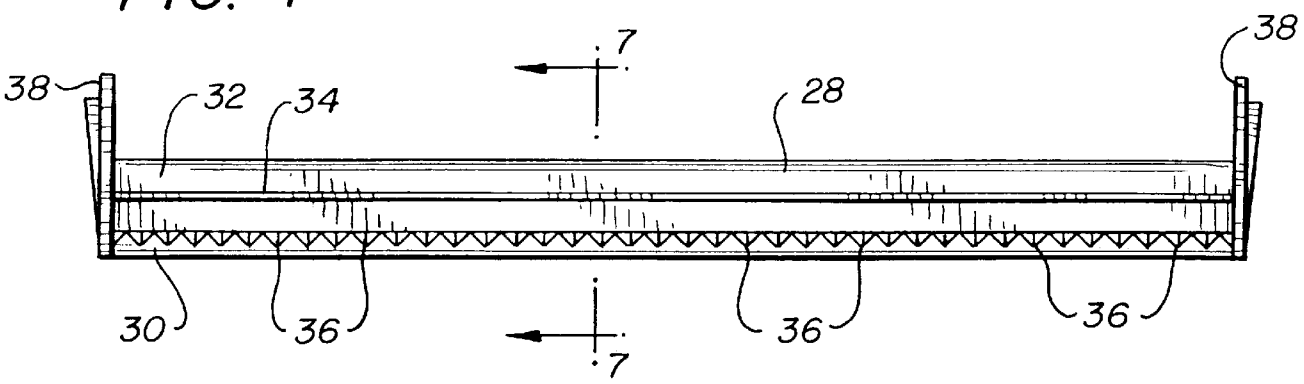
FIG. 4 is a front elevational view of a first stiffener of the present invention.
Figure 6:
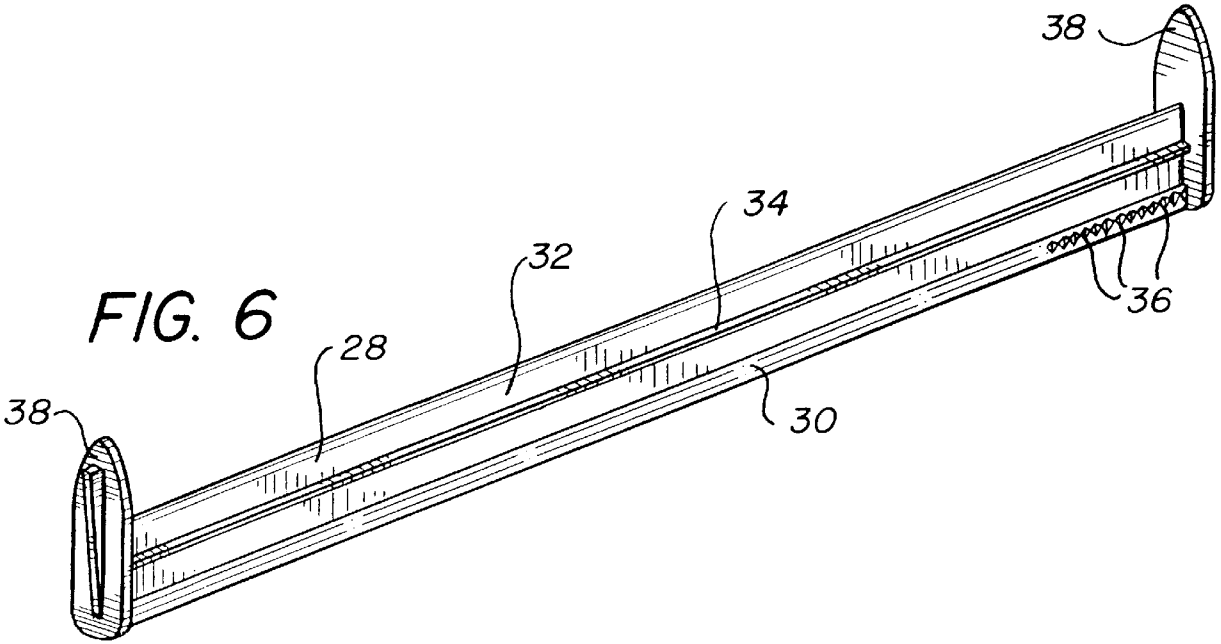
FIG. 6 is a perspective view of the stiffener of FIG. 4.
Figure 5:
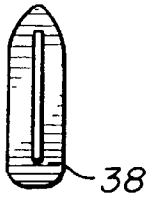
FIG. 5 is an end view of the stiffener of FIG. 4.
Figure 7:
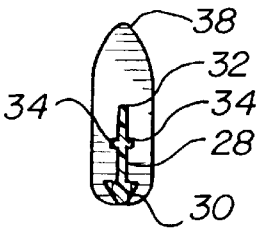
FIG. 7 is a cross-sectional view taken along line 7—7 of FIG. 4.
Figure 8:
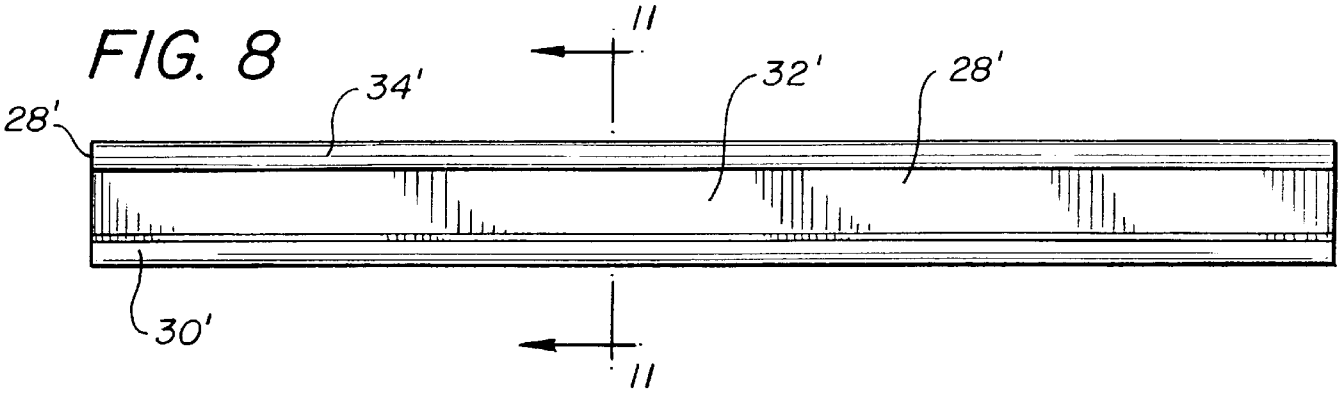
FIG. 8 is a front elevational view of a second stiffener of the present invention.
Figure 10:
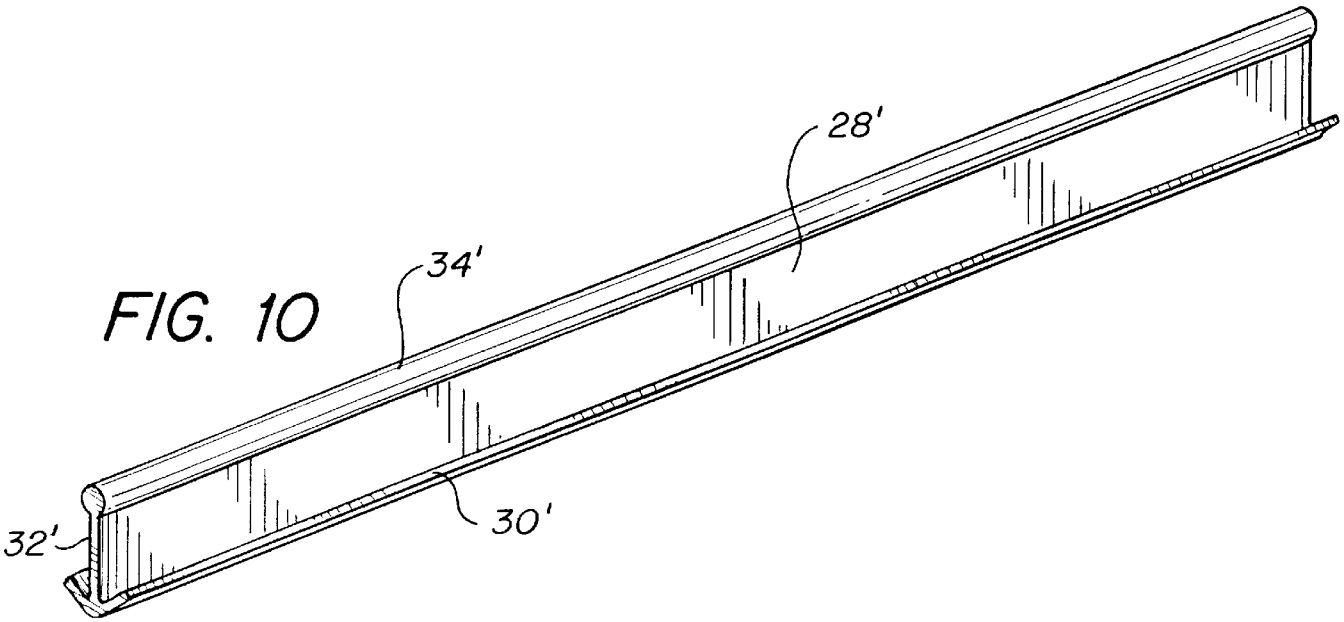
FIG. 10 is a perspective view of the stiffener of FIG. 8.
Figure 9:
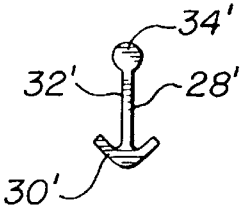
FIG. 9 is an end view of the stiffener of FIG. 8.
Figure 11:
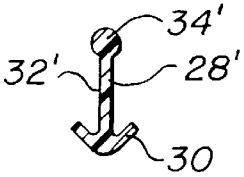
FIG. 11 is a cross-sectional view taken along line 11—11 of FIG. 8.

An elongated sponge 22 is securely clamped within channel 18. With particular reference being had to FIG. 3, prior to insertion of sponge 22 into channel 18, sponge 22 is of an essentially square, transverse cross-sectional shape, with a V-shaped channel 24 being longitudinally formed through the top surface thereof. A sheet of net-like webbing 26 is wrapped entirely around sponge 22, with opposing, terminal edges thereof meeting at the vertex of V-shaped channel 24, and a predetermined width of webbing 26 being doubled over itself along its side edges. As webbing 26 is used as a scraper, typically the side edges wear out first. The doubling over of the webbing at its ends enhances the durability of the webbing by doubling its strength. A final assembly step prior to inserting sponge 22 into channel 18 is the placement of an elongated stiffener 28 into V-shaped channel 24, whereby stiffener 28 clamps the edges of webbing 26 between itself and the vertex of V-shaped channel 24, and sponge 22 collapses therearound. The entire assembly of stiffener 28, webbing 26 and sponge 22 may then be compressed and inserted through edges 17, 19 and into channel 18. Once in channel 18, the portion of sponge 22 therein expands and bears against walls 25 and 27, thereby securely positioning the assembly within channel 18.

Figure 2:
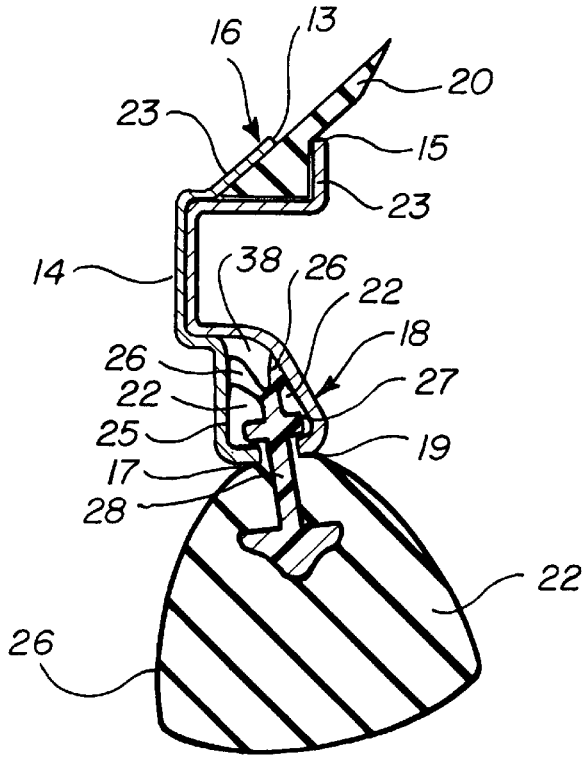
FIG. 2 is a cross-sectional view taken along line 2—2 of FIG. 1.

With particular reference to FIGS. 4–7, stiffener 28 is seen to include a cross-sectional shape of a triangular base portion 30 and an elongated stem 32 extending upwardly therefrom. A flange 34 extends perpendicularly outwardly from each of the stem's sidewalls about midway between triangular base portion 30 and the top of stem 32. The assembly of stiffener 28, webbing 26 and sponge 22 is inserted within channel 18 with flanges 34 positioned within the channel, and base portion 30 positioned outside channel 18. Accordingly, and as seen in FIG. 2, the collective width of flanges 34 (the distance from the tip of one flange to the tip of the opposing flange) is greater than the width separating edges 17 and 19 of the opening of channel 18, thereby preventing stiffener 28 from falling out of channel 18.

Once the assembly of stiffener 28, webbing 26 and sponge 22 is inserted within channel 18, sponge 22 decompresses with the portions thereof positioned within channel 18 bear against walls 25 and 27, with the sponge consequently becoming tightly clamped or squeezed between edges 17 and 19, walls 25 and 27, and stiffener 28, thereby securely retaining sponge 22 and webbing 26 tightly within channel 18. To further retain sponge 22, a plurality of triangularly shaped protrusions 36, integrally formed on the walls of triangular base portion 30, engage and grip sponge 22, thereby minimizing any slippage that may otherwise occur between sponge 22 and insert 28.

Each of rubber blade 20, sponge 22, webbing 26, and head 14 (including channels 16 and 18) are of essentially identical lengths. Therefore, each of the cleaning members (sponge 22 and webbing 26) accurately corresponds and fits within channels 16 and 18, and will not freely slide within the spaces defined therein.

In order to ensure that sponge 22 and webbing 26 do not slide outwardly from channel 18, a pair of end caps 38 are provided, one of which is securely attached, or integrally molded, to each of the ends of stiffener 28. Caps 38 are positioned on the exterior of, and in partially covering relation to, the ends of channel 18, thereby providing not only a means for retaining sponge 22 and webbing 26 within channel 18, but also preventing dirt, ice and other foreign debris from infiltrating channel 18 and thereby prematurely degrading sponge 22 and webbing 26. In addition, if head 14 is composed of metal, such as aluminum, (although it is preferably composed of plastic which is less expensive and allows head 14 to be more easily manufactured), caps 38 prevent it from contacting, and consequently scratching, a window or windshield.

An alternative to the cross-shaped stiffener 28, is an anchor-shaped stiffener 28', as is shown in FIGS. 8–11. Stiffener 28' includes a triangular base portion 30', essentially identical to base portion 30 of stiffener 28, (which may or may not include triangular protrusions 36) and a stem 32' having a rounded top end 34'. Stiffener 28' would be structurally related and assembled to sponge 22 in the same manner as stiffener 28, with rounded top 34' being positioned within channel 18 and triangular base portion 30' being positioned outside channel 18. End caps 38 may be attached, or integrally molded, to stiffener 28' in the same manner as is done with stiffener 28.

What is claimed is:

1. A cleaning assembly for attachment to a cleaning device of the type including an elongated handle having first and second opposite ends, an elongated head attached to and extending transversely across said first end, said head having first and second elongated channels formed on opposite sides thereof and extending longitudinally there across, said cleaning assembly comprising:

a) an elongated sponge;

b) a sheet of net-like webbing positioned in enveloping relation to said sponge; and c) an elongated stiffener partially positioned within said first channel and having first and second opposite ends, said first end positioned outside of said first channel and in contacting relation to said sponge and being of essentially triangular cross-section and including a plurality of protrusions extending outwardly therefrom which engage said sponge.

2. The cleaning device of claim 1 and further including an elongated rubber blade slidingly mounted within said second channel.

3. The cleaning device of claim 1, wherein said webbing includes opposite first and second edges and first and second portions extending inwardly from said first and second edges, respectively, each of which consists of at least two layers extending over a predetermined distance.

4. The cleaning device of claim 1, wherein said sponge is of an essentially square cross-section and includes a third longitudinal channel formed in, and extending along the entire length of one of the four sides thereof.

5. The cleaning device of claim 4, wherein said third channel is V-shaped.

6. The cleaning device of claim 5, wherein said first end of said stiffener is positioned within said third channel.

7. The cleaning device of claim 1, wherein said stiffener includes third and fourth opposite ends and first and second end caps fixedly attached to said third and fourth ends, respectively.

8. A cleaning assembly for attachment to a cleaning device of the type including an elongated handle having first and second opposite ends, an elongated head attached to and extending transversely across said first end, said head having first and second elongated channels formed on opposite sides thereof and extending longitudinally there across, said cleaning assembly comprising:

a) an elongated sponge;

b) a sheet of net-like webbing positioned in enveloping relation to said sponge and including first and second edges and first and second portions extending inwardly from said first and second edges, respectively, each of which consist of at least two layers; and c) an elongated stiffener partially positioned within said first channel and having an elongated stem which extends between first and second opposite ends, said first end positioned outside of said first channel and in contacting relation to said sponge and said webbing, whereby said stiffener clamps said sponge and said webbing between itself and said first channel.

9. The cleaning device of claim 8 and further including an elongated rubber blade slidingly mounted within said second channel.

10. The cleaning device of claim 8, wherein said sponge is of an essentially square cross-section and includes a third longitudinal channel formed in, and extending along the entire length of one of the four sides thereof.

11. The cleaning device of claim 10, wherein said third channel is V-shaped.

12. The cleaning device of claim 10, wherein said first end of said stiffener is positioned within said third channel.

13. The cleaning device of claim 8, wherein said stiffener includes third and fourth opposite ends and first and second end caps fixedly attached to said third and fourth ends, respectively.

* * * * *